US006888713B2

(12) United States Patent
Stamps

(10) Patent No.: US 6,888,713 B2
(45) Date of Patent: May 3, 2005

(54) DEVICE AND METHOD TO MITIGATE HYDROGEN EXPLOSIONS IN VACUUM FURNACES

(76) Inventor: Douglas Wayne Stamps, 5645 N. Cypress, Newburgh, IN (US) 47630

( * ) Notice: Subject to any disclaimer, the term of this patent is extended or adjusted under 35 U.S.C. 154(b) by 971 days.

(21) Appl. No.: 09/745,575

(22) Filed: Dec. 21, 2000

(65) Prior Publication Data

US 2002/0117093 A1 Aug. 29, 2002

(51) Int. Cl.[7] ..... F23Q 3/00
(52) U.S. Cl. ..... 361/250; 361/253; 361/263
(58) Field of Search ..... 361/247, 253, 361/250, 248, 263

(56) References Cited

U.S. PATENT DOCUMENTS 5,108,696 A 4/1992 Heck ..... 376/300
5,473,646 A 12/1995 Heck ..... 376/301
5,740,217 A 4/1998 Spinks ..... 376/301
5,889,831 A * 3/1999 Kolev ..... 376/300
6,222,719 B1 * 4/2001 Kadah ..... 361/247

* cited by examiner

*Primary Examiner*—Stephen W. Jackson

(57) ABSTRACT

A device to mitigate hydrogen explosions in a vacuum furnace includes at least one igniter, an ignition transformer, and an electrical switch. The at least one igniter includes a set of high-voltage electrodes and is connected to the ignition transformer by high-voltage wires. The electrical switch activates the ignition transformer to provide power to the at least one igniter forming a continuous electrical arc between the electrodes. The at least one igniter is located inside the vacuum furnace at an opening where air may enter the vacuum furnace, which may contain a hydrogen and steam gas mixture under accident conditions. The device consumes hydrogen by controlled combustion as flammable mixtures are formed.

13 Claims, 2 Drawing Sheets

DEVICE AND METHOD TO MITIGATE HYDROGEN EXPLOSIONS IN VACUUM FURNACES

BACKGROUND

1. Field of Invention

This invention relates to a method and device for controlled combustion of accidentally formed explosive mixtures contained within vacuum furnaces, in particular vacuum induction-melt furnaces and vacuum arc-melt furnaces, having at least one igniter and at least one ignition source.

2. Description of Prior Art

It has been a long-standing problem that explosions occur in the processing and casting of reactive metals, such as titanium and zirconium. For example, since the commercial development of the titanium processing industry in the early 1950's, there has been a continual problem of explosions with catastrophic loss of human life and/or capital equipment.

The explosions form under accident conditions. The accident begins when water comes in contact with the molten reactive metal. In the case of the vacuum arc-melting furnaces, one mode of failure occurs when the tip of a water-cooled non-consumable electrode blows off and high-pressure water is injected directly into the crucible containing the molten metal. Another failure mode occurs when the electrode arcs to the water-cooled crucible, melts part of the crucible, and releases the cooling water, which is under high pressure. A similar failure mode occurs in vacuum induction-melt furnaces when the induction field is not contained within the melt, locally melts part of the water-cooled crucible, and releases the high-pressure water. A copious amount of steam is produced when the water comes into contact with the molten metal, which can generate a pressure excursion by itself. Additionally, the molten metal chemically reacts with the steam, stripping the oxygen from the steam to form a metal oxide, and liberating large quantities of hydrogen. The furnace then contains only hydrogen and steam since the furnace was initially under a strong vacuum and originally contained no air. The hydrogen and steam, which are then above atmospheric pressure, are vented to the atmosphere through a venting device so that the hydrogen and steam are eventually relieved to atmospheric pressure. As the steam condenses and produces a slight vacuum, air is drawn into the furnace to create a potentially explosive hydrogen-air-steam mixture. An explosion occurs when the mixture comes into contact with a random ignition source, such as a spark or hot surface.

A number of "solutions" for each of these problems have been proposed and implemented but all have ultimately failed to prevent continued explosions from occurring in the furnaces and damaging equipment. For example, melting is now done with as short an arc as possible, controls have been installed to maintain clearance between the electrode and the crucible, and interlocks have been installed to shut down power if the water pressure is lost. However, explosions continue to occur because new failure modes are continually identified.

It eventually became apparent to the industry that, despite their best use of controls, explosions were always possible. It was apparent that the prevention of hydrogen explosions was an insoluble problem and the industry has resigned itself to protecting personnel and equipment, rather than eliminating the explosion per se. The furnaces are now constructed to withstand moderate internal pressure with appropriate venting to relieve internal pressure. A bunker with one frangible wall shields the furnace. The frangible wall, preferably an outside wall, is designed to blow out in the event of an explosion and direct the blast away from personnel and other equipment within the building. By use of optics, such as video cameras, the operators can be isolated from the furnace in control rooms. This "solution", however, does not prevent the explosions and still results in serious damage to the furnace and loss of production from downtime.

The reactive metals processing industry has made many attempts to prevent hydrogen explosions over the past nearly 50 years, each attempt being unsuccessful in its ultimate objective because of the random cause of the accidents. There is a long-felt need to solve this seemingly insoluble problem but the industry has resigned itself to the existence of hydrogen explosions. The industry's current approach is to use the best controls available to reduce the probability of an explosion but recognize its possibility and confine the furnace to limit the effects of its damage.

A different industry, the nuclear power industry, must also address the possibility of a hydrogen explosion under severe accident conditions. Under degraded reactor core conditions, hydrogen can be injected under high pressure into a steamy air atmosphere in the nuclear reactor containment. The hydrogen injection location will be unknown and will depend on each accident scenario. Different means to control the hydrogen have been employed: (1) dilute the hydrogen with air contained in very large containments to render the mixture nonexplosive, (2) eliminate the hydrogen through catalytic recombination, and (3) consume the hydrogen through controlled combustion using igniters.

The unique accident conditions in the vacuum furnaces preclude the use of most techniques used in nuclear power plants. For example, in a nuclear power plant the initial composition of the mixture in the containment is just air and steam prior to the injection of hydrogen. The mixture is initially nonflammable (no fuel is present) and can remain nonflammable as the hydrogen is introduced into the containment given a large enough initial quantity of air to thoroughly dilute the hydrogen. In a vacuum furnace, on the other hand, the initial composition of the mixture is just hydrogen and steam. As the air is introduced into the furnace, the mixture would change from initially nonflammable (no oxidizer present), to explosive as sufficient air is added, and then back to nonflammable (too little fuel) if sufficiently large quantities of air are added. Dilution of the hydrogen-steam mixture with air does not eliminate the possibility of an explosion in a vacuum furnace. Likewise, the use of catalytic recombiners, as illustrated in U.S. Pat. Nos. 5,473,646 and 5,740,217 for nuclear power plants, are expensive, designed for use in hydrogen-lean hydrogen-air-steam mixtures, and may recombine the hydrogen too slowly to render the mixture nonflammable at all times.

The use of igniters to remove hydrogen through controlled combustion can overcome the previously mentioned disadvantages but the novel features of accident conditions in vacuum furnaces do not make this an obvious choice. The prior art describes the use of igniters only in nuclear power plants and not for the unique conditions encountered in the reactive metals processing industry. In nuclear power plants under accident conditions, the injected gas is a fuel, hydrogen, while in vacuum furnaces the gas drawn into the furnace is the oxidizer, air. No prior art describes the use of deliberate ignition of oxidizer jets. In nuclear power plants, the injected gas, hydrogen, is lighter than the surrounding air-steam atmosphere and floats. In the vacuum furnace, the air drawn into the furnace is heavier than the surrounding hydrogen-steam atmosphere and may sink or initially rise depending on the momentum of the incoming jet. Igniter placement is critical to controlled combustion and the prior art for the nuclear power industry does not provide any guidance for jets heavier than the surrounding atmosphere.

A device for controlled combustion of an ignitable hydrogen-air mixture in a nuclear power plant is described in U.S. Pat. No. 5,108,696. The device consists of an ignition source connected to a spark igniter. The ignition source has at least two different trip elements: one in response to a pressure rise and another in response to a temperature rise. These tripping elements are suitable for accident conditions in a nuclear power plant. However, for the unique conditions in a vacuum furnace, the mixture only becomes flammable when air enters the furnace.

Furthermore, the prior art does not describe a method by which the igniters should be used to mitigate a hydrogen explosion in a vacuum furnace. For example, igniters have been used in nuclear power plants but the geometry of a nuclear power plant is substantially different than that of a vacuum furnace. The nuclear power plant is surrounded by a very large containment divided into smaller compartments. A vacuum furnace, on the other hand, has a single melting chamber tank with a significantly smaller volume than that of a nuclear containment. Igniter placement is critical. A poorly placed igniter in a vacuum furnace would be no better than the random ignition sources that create the hydrogen explosions during accidents. The proper method when using igniters in a vacuum furnace can yield the difference between controlled combustion and a catastrophic explosion.

All prior art references for the controlled combustion of hydrogen during accident conditions are from a different technical field, the nuclear power industry. The devices, as described, are not suitable for the unique conditions associated with hydrogen explosions in the reactive metal processing industry and methods of their use to prevent explosions in vacuum furnaces are not described.

SUMMARY OF THE INVENTION

Accordingly, several objects and advantages of the present invention are:

(a) to provide a device that can remove hydrogen under accident conditions in a vacuum furnace through the deliberate ignition of hydrogen-air-steam mixtures;

(b) to provide a device to activate an igniter when air has potentially entered the vacuum furnace;

(c) to provide a device of uncomplicated construction that can remove hydrogen in the vacuum furnaces economically; and (d) to provide a method for controlled combustion of hydrogen-air-steam mixtures in the vacuum furnace that can mitigate a hydrogen explosion.

Further objects and advantages will become apparent from a consideration of the drawings and ensuing description.

DESCRIPTION OF THE PREFERRED EMBODIMENTS

In accordance with the present invention a device to mitigate hydrogen explosions in a vacuum furnace comprises an electrical switch, a high-voltage ignition transformer controlled by the electrical switch, and a set of high-voltage electrodes having power supplied by the transformer to ignite a combustible mixture in the vacuum furnace. A method is disclosed to locate the device in the vacuum furnace so as to consume the combustible mixture in a controlled manner and mitigate an explosion.

Figure 1:
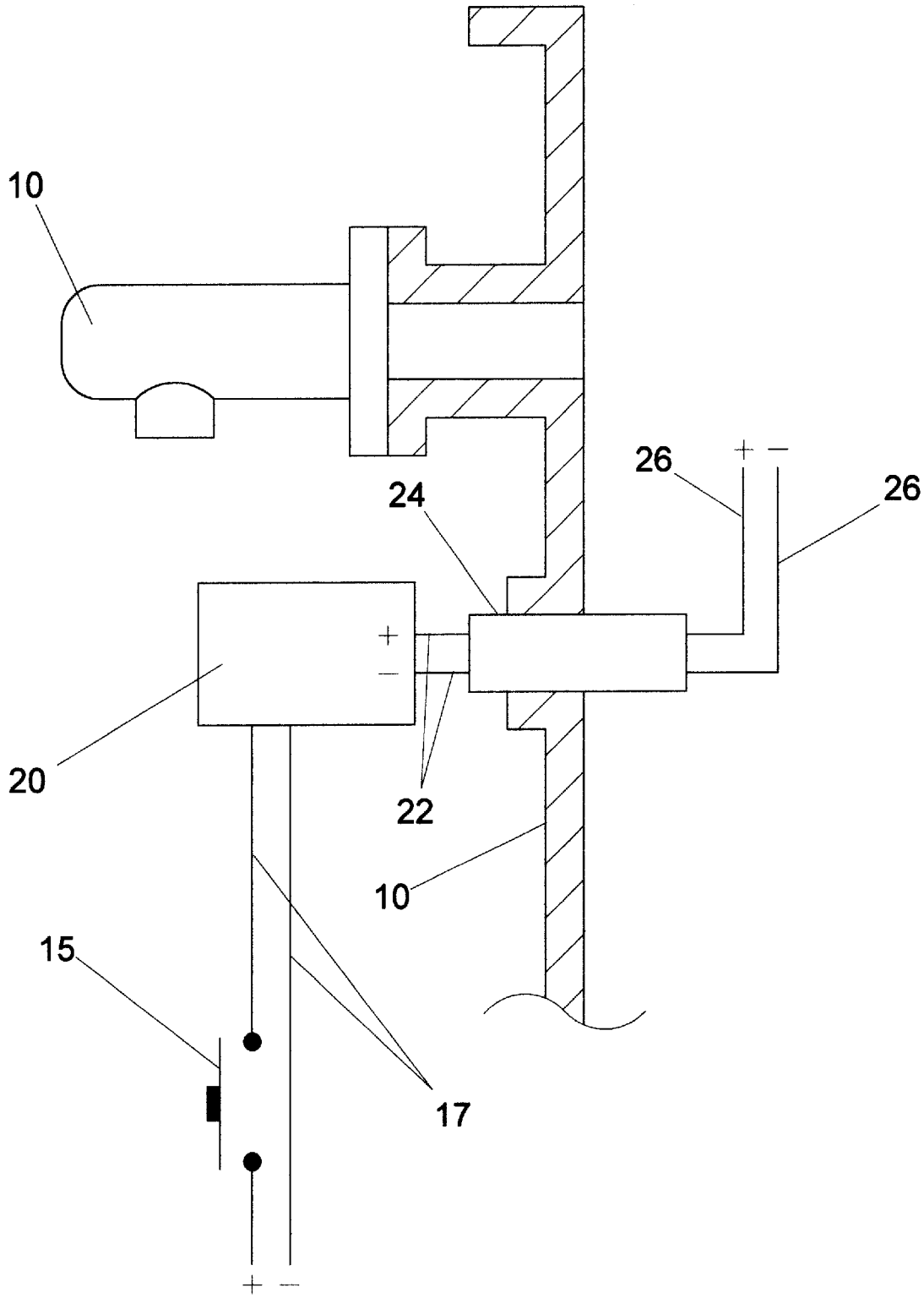
FIG. 1 shows a block diagram of the basic embodiment of the device.

A typical embodiment of the device of the present invention is illustrated in FIG. 1. A set of electrodes 26 is located inside a melt chamber tank 28. The set of electrodes 26 is positioned near a location where air can enter the melt chamber tank 28, including a pressure relief device 10. A pair of high-voltage wires 22 is connected to the electrodes 26. The pair of high-voltage wires 22 have a positive and negative electrical line. The pair of high-voltage wires 22 pass through the wall of the melt chamber tank 28 by a vacuum-tight feedthrough 24. An ignition transformer 20 on the outside of the melt chamber tank 28 is connected to the pair of high-voltage wires 22. Power is supplied to the ignition transformer 20 through a pair of electrical wires 17 having a positive and negative potential. An electrical switch 15 is connected to the positive line of the pair of electrical wires 17.

Figure 2:
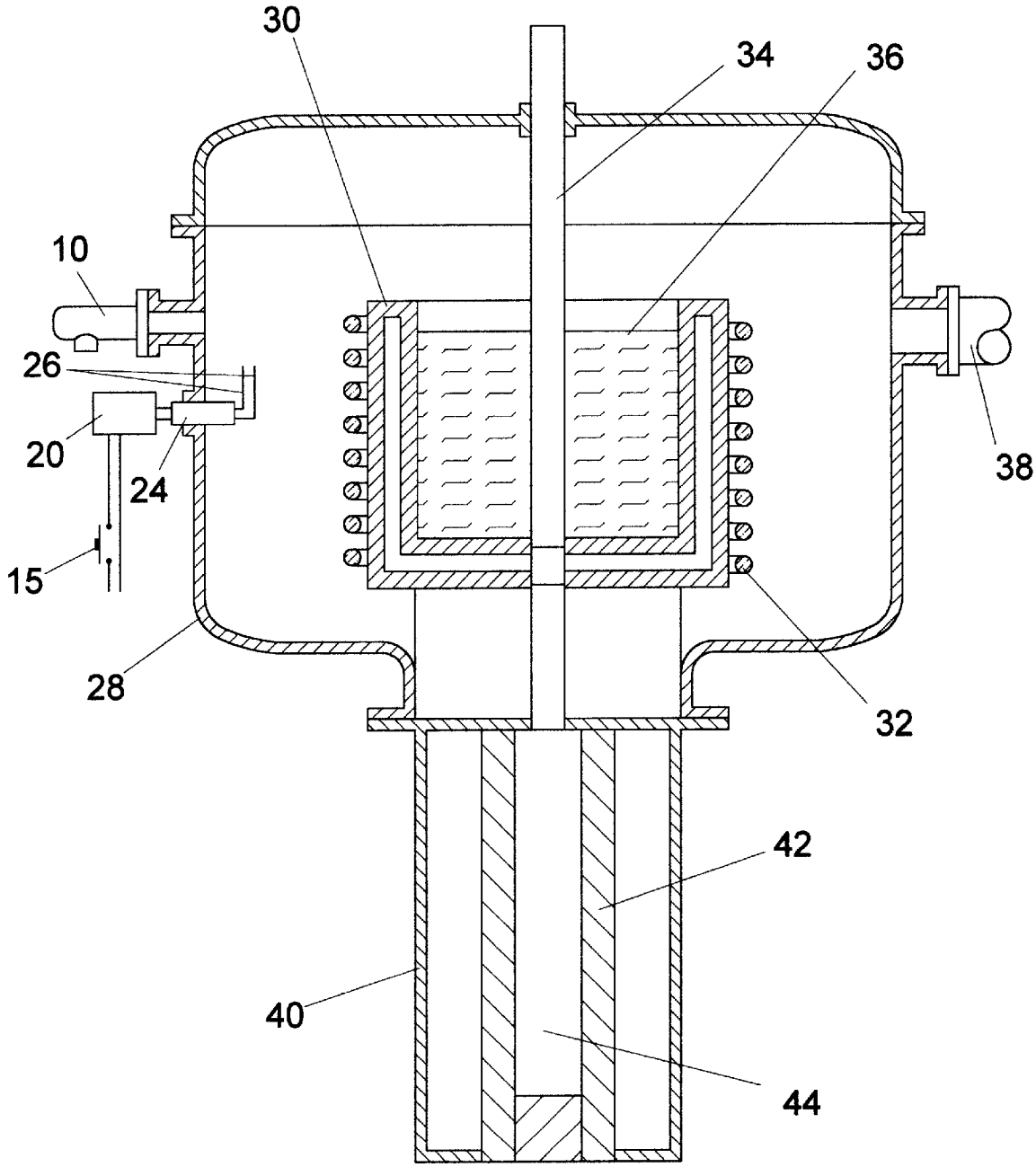
FIG. 2 shows the generalized features of a vacuum induction melt furnace and the general location of the device.

FIG. 2 shows a typical vacuum-melting furnace with induction heating and bottom pouring. This type of vacuum furnace is used to illustrate the method of use of the device shown in FIG. 1 to mitigate hydrogen explosions. The device illustrated in FIG. 1 can be used with any vacuum furnace and is not restricted to the particular furnace illustrated in FIG. 2. The vacuum furnace illustrated in FIG. 2 contains a crucible 30 whose walls are bored and cooled by circulating water within the crucible (inlet and exit lines not shown). The crucible 30 contains a charge 36 of molten metal. A control rod with plug 34 contains the charge in the crucible 30. The crucible 30 is surrounded by induction coils 32, which heat the charge 36. The melt chamber tank 28 contains the crucible 30. A vacuum is maintained within the melt chamber tank 28 by evacuating the atmosphere of the melt chamber tank 28 through a vacuum pumping line 38. A pressure relief device 10 is attached to the melt chamber tank 28 to relieve pressure under accident conditions. A set of high-voltage electrodes 26 is placed inside the vacuum furnace near locations where air may enter. In this illustration, the set of high-voltage electrodes 26 is located near the pressure relief device 10. The electrical components of the ignition device have been described and are shown in FIG. 1. The melt chamber tank 28 is connected to a mold chamber tank 40 but the connection is sealed during the melting of the charge 36. The mold chamber tank 40 contains a mold 42. A cavity 44 in the mold 42 casts the molten metal charge 36 when the control rod 34 is raised.

The present invention is intended to operate only under off-normal conditions in a vacuum furnace. As an illustration, an accident sequence will first be described followed by a description of how the present invention operates under the accident conditions. Many different accident sequences that produce hydrogen are possible, although the operation of the prevent invention remains the same.

Under normal operating conditions during the melting of a charge 36 (shown in FIG. 2), the melt chamber tank 28 is isolated from the mold chamber tank 40. A high vacuum is maintained in the melt chamber tank 28 by evacuating the atmosphere in the melt chamber tank 28 through the vacuum pumping line 38.

One type of accident occurs when the induction field is not contained within the charge 36 and the crucible 30 heats up and melts in a local region. The water circulating within the crucible 30 is released and sprays upon the molten charge 36 contained in the crucible 30. The charge 36 of molten metal boils the water vigorously and produces copious quantities of steam. Simultaneously, the highly reactive molten metal charge 36 combines chemically with the steam, stripping the oxygen from the steam, and liberating molecular hydrogen in gaseous form. The large production of steam and hydrogen overwhelms the vacuum pump's capacity to maintain a vacuum through the vacuum pumping line 38 and the pressure inside the melt chamber tank 28 exceeds atmospheric pressure. The pressure relief device 10 opens when its pressure set point is exceeded and exhausts part of the hydrogen and steam contained in the melt chamber tank 28. The pressure relief device 10 is designed to reseat once the pressure in the melt chamber tank 28 drops below the set point of the pressure relief device 10. However, pressure relief devices occasionally remain stuck open. In the event this happens, air will be drawn into the melt chamber tank 28 as the steam condenses when the tank 28 cools and creates a partial vacuum. As the air enters the melt chamber tank 28, it mixes with the hydrogen and steam to produce a flammable mixture.

In the typical embodiment of the present invention, the ignition device is operated manually. A person operating the vacuum furnace would manually activate the ignition device based on signals from the vacuum furnace that an accident was in progress. The operator would close the electrical switch 15 to provide line voltage to the ignition transformer 20. The ignition transformer 20 transforms the line voltage to a high voltage potential across the set of electrodes 26. The spacing of the electrodes 26 is such that they provide a continuous electrical arc of sufficient power to ignite marginally flammable mixtures contained in the melt chamber tank 28. The ignition device must be activated before flammable mixtures form. Further embodiments of the present invention describe devices to automate the activation of the ignition device.

The method for the proper use of the present invention will now be disclosed. The proper use of the device depends on the proper location of the electrodes 26 relative to the pressure relief device 10. Care must be taken that the electrodes are neither too close or too far away from the opening of the pressure relief device 10 into the melt chamber tank 28. If the electrodes 26 are too close to the opening, the electrodes 26 will be situated within the plume of air drawn into the tank 28 and will not be exposed to a flammable mixture. This can allow significant mixing of the air with the hydrogen and steam throughout the remainder of the melt chamber tank 28 and, ultimately, result in a large explosion when the melt chamber tank 28 is eventually filled with a flammable mixture. Likewise, if the electrodes 26 are located too far from the opening of the pressure relief device 10 into the melt chamber tank 28, significant mixing can occur before a flammable mixture comes into contact with the electrodes 26. Either way, the resulting hydrogen explosion that occurs from a deliberate ignition can generate pressures that differ little from accidental random ignition. In fact, improper use of deliberate ignition can be considered worse than random ignition since a hydrogen explosion is guaranteed.

A set of experiments was performed to determine the appropriate location of an igniter in a vessel subjected to conditions typical of accidents in a vacuum furnace. The vessel was a cylinder 147.3 cm (58 inches) long and 40.6 cm (16 inches) in diameter. The vessel was mounted with the long axis horizontal. The vessel contained a 7.6 cm (3 inch) diameter gate valve mounted horizontally on one end of the cylinder and was used to simulate a pressure relief device. The gate valve was located on the horizontal centerline of the cylinder's end and midway between the cylinder's center and outer diameter. The vessel was initially evacuated to remove all of the air. Steam was injected and warmed the vessel so that the steam pressure was greater than atmospheric pressure. Hydrogen was injected centrally at the bottom of the vessel. The total amount of hydrogen injected was between 28% and 35% by volume with the balance being steam. The gate valve was then opened, releasing the hydrogen and steam to the surrounding atmosphere, and remained opened throughout the rest of the test to simulate a stuck-open pressure relief device. This allowed the air to be drawn into the vessel as the steam condensed.

This concentration of hydrogen can be considered the worst case for the following reason. If all of the steam in the vessel condensed and was replaced with air, the resulting hydrogen-air mixture would be approximately a stoichiometric mixture. A stoichiometric mixture is a chemically balanced mixture between the fuel (hydrogen) and oxidizer (air). A stoichiometric mixture of hydrogen and air contains 29.5% hydrogen by volume, which is within the range of hydrogen concentrations tested. A stoichiometric mixture is the most chemically sensitive mixture possible. It requires the least amount of energy to ignite and produces the greatest explosion pressure.

Two different types of tests were conducted: one with the vessel wall cooled by water and one with the vessel wall cooled by natural convection to the surrounding air. These two different types of tests were conducted because some vacuum furnaces have water-cooled external walls. The significance of these two different types of tests is that the rate in which the vessel cools affects the rate at which air is drawn into the vessel. For example, the water-cooled vessel will condense steam inside the vessel faster than a vessel that is cooled using natural convection. Air will be drawn into the water-cooled vessel faster than a vessel cooled by natural convection.

The same type of igniter and igniter location were used in both types of tests. Diesel thermal glowplugs were used as the igniter. In each type of test, the glowplug was located approximately 7.6 cm (3 inches) into the vessel and 7.6 cm (3 inches) horizontally from the centerline of the gate valve opening to the vessel. The glowplug was activated prior to the opening of the gate valve since glowplugs require approximately 40–60 seconds to reach their operating temperature.

Both types of tests exhibited different combustion behavior but the pressure excursions were very low in each case. In the case with natural convective cooling of the vessel, one relatively slow burn occurred generating a maximum pressure rise of 15.2 kPa (2.2 psi), a pressure well below the design pressure of a vacuum furnace. In the case where water cools the vessel, a series of small bums was observed with no measurable pressure rise. The existence of these small burns was established by a recorded rise in the gas temperature and a unique repetitive audible signature emitted from the vessel. In both cases, the measured pressure rise was significantly less than the predicted maximum pressure of approximately 828 kPa (120 psi) from a stoichiometric hydrogen-air explosion.

These are new and unexpected results for the use of a deliberate ignition system in a vacuum furnace as opposed to results obtained for a nuclear power plant application. In a nuclear power plant, when an igniter comes into contact with a flammable mixture, the flame front bums back to the source of incoming hydrogen and the hydrogen plume burns. The hydrogen burns continuously as it is injected under high pressure into the nuclear reactor containment. In the case of a vacuum furnace, a series of repetitive burns are observed. This behavior occurs because a slight vacuum created from the condensing steam draws the air into the furnace. When the first burn occurs, a small rise in pressure from the bum stops the inflow of air and the burn heats the gas remaining in the furnace. The burn is extinguished as the flow of air stops. As the gas in the furnace cools and more steam condenses, more air is drawn into the furnace and the process repeats itself. The repetitive burns occur because of the unique conditions associated with the vacuum furnace and the reactive metals processing industry.

The method can now be generalized to vacuum furnaces of different sizes. In the experiments described previously, the igniter was located approximately 7.6 cm (3 inches) into the vessel and 7.6 cm (3 inches) off the centerline parallel to the axis of the opening. The circular opening was 7.6 cm (3 inches) in diameter, D. So, the generalized method of locating the electrodes in the present invention is one diameter into the vessel and one diameter off the centerline of the circular opening to the vacuum furnace and in the same horizontal plane. For openings other than circular, the hydraulic diameter can be used. The hydraulic diameter, $D_h$, is defined as 4 times the area of the opening, A, divided by the perimeter of the opening, P, or in other words, $D_h=4A/P$. If the furnace geometry does not permit this exact arrangement or the opening of the pressure relief device is far from circular, the location of the igniter may be extended farther out and to the side of the opening in equal proportions, noting however, that the farther out the igniter is placed, the greater the pressure can be upon ignition.

Although my invention is illustrated and described herein as embodied in a device for the mitigation of explosions of hydrogen-air-steam mixtures in vacuum furnaces for the metals processing industry, the specificities of the device should not be construed as limitations on the scope of my invention, but rather as an exemplification of one embodiment thereof. Various modifications may be made to this invention without departing from the spirit of this invention and still be within the scope and range of equivalents of the claims.

Many different types of igniters and associated hardware are further embodiments of my present invention. Spark igniters, for example automotive spark plugs, and the appropriate electrical hardware to produce intermittent high-voltage sparks may be used in place of the continuous-arcing electrodes and the high-voltage ignition transformer. Thermal glow plugs or other hot surface igniters, for example diesel glow plugs, and their appropriate low-voltage high-amperage direct current source could be used. Catalytic igniters suitably designed for the ignition of weakly flammable hydrogen-air-steam mixtures could be used. A piezo-quartz igniter, for example, like igniters used in propane gas grills, could be used if a suitable mechanical actuating device is employed. A pilot light could be used if the flame could be exposed to the interior of the vacuum furnace only under accident conditions since the furnace must otherwise operate under a strong vacuum. Wires melted rapidly by electrical means, for example pyrofuse wire or exploding bridgewires, can be used if a plurality of wires are available. Hypergolic substances may also be used.

A plurality of igniters may be used for two different reasons. In the first case, a different igniter should be used at every potential location where air could enter into the furnace. For example, an additional igniter should be located near the vacuum pump line if pump failure could allow air to enter into the furnace. A second reason for a plurality of igniters is to provide redundancy for additional safety. Two or more igniters may be placed at or near the primary igniter. The additional igniters may also have separate sources of power to provide further redundancy and safety.

Further embodiments of the invention may use other components to automatically activate the igniter. The present invention could activate automatically from the movement of the pressure relief device. The movement of the pressure relief device could be used to close a set of electrical contacts that would provide power to the ignition transformer. The present invention could include sensors that would activate the igniter automatically when electrical signals from the sensors exceed an adjustable limit value. This could include a sensor to detect steam, which would indicate the existence of an accident or could include an oxygen or hydrogen sensor to detect the presence of a potentially explosive mixture. The sensors can be connected to a controller comprising low-voltage relays that can be actuated when an adjustable limit value of the sensor is exceeded. The relays would automatically supply power to the ignition transformer. The present invention could include a pressure switch to activate the device automatically. When the pressure inside the vacuum furnace exceeds an adjustable limit value, the pressure switch would close a set of contacts and automatically provide power to the ignition transformer. The present invention could activate automatically from electrical signals sent to the operator's control panel that indicate off-normal conditions in the vacuum furnace. These signals would be interlocked with the igniter. A set of contacts would be closed to automatically provide power to the ignition transformer if off-normal condition signals are sent to the control panel. This would include a signal to indicate loss of pressure in the water line that provides cooling water for furnace components, such as the electrode or crucible.

The reactive metals processing industry has experienced hydrogen explosions, and the concomitant loss of human life and equipment, for nearly half a century. There has been a long felt need to prevent the damage that accompanies the explosions. Many attempts have been made to prevent the explosions from occurring. However, the nature of the accidents is so complex and the numbers of ways an accident can occur are so numerous that explosions continue to occur. The industry has resigned itself to the containment, rather than the prevention, of the explosions. Vacuum furnaces are now protected with bunkers. However, explosions still occur, furnaces are damaged, and production of metal halted during repairs.

The present invention mitigates hydrogen explosions in vacuum furnaces used in the reactive metals processing industry. The device of this invention can remove hydrogen under accident conditions in a vacuum furnace through the deliberate ignition of hydrogen-air-steam mixtures. The hydrogen is removed with only a small rise in pressure, and therefore, solves the problem of equipment damage that has been insoluble for the past nearly 50 years. The invention provides a device of uncomplicated construction that can remove hydrogen economically.

The present invention also discloses a method by which the device can be used effectively to mitigate hydrogen explosions. Without the disclosure of this method, improper use of this device can lead to hydrogen explosions.

This is the first use of a device to deliberately ignite an oxidizer (air) jet. It has unique characteristics over the only other known use of deliberate ignition to control hydrogen in an accident, which is in nuclear power plant containments. In a nuclear power plant, the hydrogen fuel is ignited as it enters the containment and burns continuously in a plume. In the reactive metal processing application, the air is ignited as it enters the furnace and produces a series of short repetitive burns. The proper use of the igniters is not obvious because of these new and unexpected results. The present invention provides a method for the controlled combustion of hydrogen-air-steam mixtures in the vacuum furnace that can mitigate a hydrogen explosion.

There are many different ramifications of this invention. This device may be used in all different types of vacuum induction melt furnaces, including but not limited to: (1) a bottom-pouring furnace with a removable bottom plug in the crucible, (2) a bottom-pouring furnace with a metal plug that is melted with an auxiliary high-frequency induction coil, (3) a fixed position furnace with tiltable crucible, and (4) a tilting furnace with flanged mold. More generally, the device may be used to mitigate explosions in any vacuum furnace, for example induction-melt and electric arc-melt furnaces.

The device may be used in any chamber in which the molten metal may come into contact with water. This includes, but not limited to, all processes involving the melting and casting of reactive metals. For example, the device can be used in the melt chamber of a vacuum arc furnace since the water-cooled electrodes can spray water on the melt under accident conditions. The device may also be used in the mold chamber tank of a vacuum furnace since the molds are water-cooled.

The scope of this invention should be determined not by the embodiments illustrated, but by the appended claims and their legal equivalents.

What is claimed is:

1. Device to mitigate an explosion of a flammable mixture in a vacuum furnace, comprising:

(a) at least one igniter inside said vacuum furnace for initiating the combustion of said flammable mixture, (b) at least one ignition source connected to said at least one igniter for providing power to said at least one igniter, (c) activation means for activating power from said at least one ignition source to said at least one igniter before said flammable mixture forms, whereby said flammable mixture can be removed by controlled combustion from said vacuum furnace.

2. Device of claim 1, wherein said at least one igniter comprises a set of ignition electrodes, said ignition electrodes having a sufficient spacing therebetween and sufficient voltage potential difference to ignite said flammable mixture.

3. Device of claim 1, further including a vacuum-tight feedthrough that separates said flammable mixture inside said vacuum furnace from an external air atmosphere.

4. Device of claim 1, further including a set of ignition wires connecting said ignition electrodes to said ignition source and wherein said ignition wires pass through said vacuum-tight feedthrough.

5. Device of claim 1, wherein said ignition source comprises at least one ignition transformer.

6. Device of claim 1, wherein said activation means comprises an electrical switch that activates said at least one ignition transformer to provide power to said at least one igniter.

7. A method for mitigating an explosion of a flammable mixture in a vacuum furnace, comprising the steps of:

(a) providing at least one igniter for initiating the combustion of said flammable mixture in said vacuum furnace, (b) placing said at least one igniter inside said vacuum furnace at an opening where external air may enter said vacuum furnace, (c) providing at least one ignition source to supply power to said at least one igniter, (d) providing activation means for activating power from said at least one ignition source to said at least one igniter before said flammable mixture forms, whereby said flammable mixture can be removed by controlled combustion from said vacuum furnace.

8. A vacuum furnace, comprising:

(a) at least one tank comprising a device to mitigate an explosion of a flammable mixture in said tank by the controlled combustion of said flammable mixture, said device including:

(b) at least one igniter inside said tank for initiating the combustion of said flammable mixture, (c) at least one ignition source connected to said at least one igniter for providing power to said at least one igniter, (d) activation means for activating power from said at least one ignition source to said at least one igniter before said flammable mixture forms, whereby said flammable mixture can be removed by controlled combustion from said vacuum furnace.

9. Device of claim 8, wherein said at least one igniter comprises a set of ignition electrodes, said ignition electrodes having a sufficient spacing therebetween and sufficient voltage potential difference to ignite said flammable mixture.

10. Device of claim 8, further including a vacuum-tight feedthrough that separates said flammable mixture inside said tank from an external air atmosphere.

11. Device of claim 8, further including a set of ignition wires connecting said ignition electrodes to said ignition source and wherein said ignition wires pass through said vacuum-tight feedthrough.

12. Device of claim 8, wherein said ignition source comprises at least one ignition transformer.

13. Device of claim 8, wherein said activation means comprises an electrical switch that activates said at least one ignition transformer to provide power to said at least one igniter.

* * * * *